US008375969B2

(12) United States Patent
McCarty, Sr.

(10) Patent No.: US 8,375,969 B2
(45) Date of Patent: Feb. 19, 2013

(54) CANOPY

(76) Inventor: Michael Duane McCarty, Sr., East China, MI (US)

( * ) Notice: Subject to any disclaimer, the term of this patent is extended or adjusted under 35 U.S.C. 154(b) by 0 days.

(21) Appl. No.: 13/026,950

(22) Filed: Feb. 14, 2011

(65) Prior Publication Data

US 2011/0209738 A1 Sep. 1, 2011

Related U.S. Application Data

(60) Provisional application No. 61/303,936, filed on Feb. 12, 2010.

(51) Int. Cl.
*E04H 15/34* (2006.01)

(52) U.S. Cl. ..... 135/122

(58) Field of Classification Search ..... 135/121, 135/122, 157, 158, 160
See application file for complete search history.

(56) References Cited

U.S. PATENT DOCUMENTS 1,347,808 A * 7/1920 Franklin ..... 403/119
2,001,215 A * 5/1935 Ruppel ..... 52/653.2
2,783,766 A 3/1957 Kohlbeck
3,042,052 A 7/1962 Des Rosier
3,424,178 A * 1/1969 Yazaki ..... 135/157
3,766,573 A * 10/1973 Burkholz et al. ..... 4/498
3,779,259 A 12/1973 Fuller
3,960,162 A 6/1976 Noel
4,236,543 A 12/1980 Moss
4,320,744 A 3/1982 Fodor et al.
4,381,629 A 5/1983 Ahn
4,719,935 A 1/1988 Gustafson
4,844,108 A 7/1989 Rohrer
4,937,969 A 7/1990 Kawabe et al.
5,216,948 A 6/1993 Sheppard et al.
5,261,435 A 11/1993 Stanley et al.
5,365,961 A 11/1994 Bamber et al.
5,551,464 A 9/1996 Kelly
5,582,197 A 12/1996 Dobberstein
5,584,311 A * 12/1996 Schaefer ..... 135/128
5,700,102 A * 12/1997 Feleppa ..... 403/170
5,711,337 A * 1/1998 McKenney ..... 135/121
5,836,331 A 11/1998 Grahn
5,964,233 A 10/1999 Clark et al.
6,006,769 A 12/1999 Lin
6,170,499 B1 1/2001 Lin
6,170,503 B1 * 1/2001 Lin Shy ..... 135/119
6,302,094 B1 10/2001 Wehrly et al.
6,397,869 B1 6/2002 Jennings
6,401,737 B1 6/2002 Kloor, III
6,421,963 B1 7/2002 Pratola
6,491,051 B2 12/2002 Pierce et al.
6,510,565 B1 1/2003 Zwezdaryk
6,520,195 B1 2/2003 O'Neal et al.
6,662,816 B1 12/2003 Cunningham
6,679,009 B2 1/2004 Hotes
6,745,521 B1 * 6/2004 Klemming ..... 52/79.6
6,782,668 B2 8/2004 Bruce
6,938,631 B2 9/2005 Gridley
6,981,914 B2 1/2006 Veenstra
6,996,941 B1 * 2/2006 Maschoff ..... 52/79.5

(Continued)

*Primary Examiner* — Noah Chandler Hawk
(74) *Attorney, Agent, or Firm* — Harness, Dickey & Pierce, P.L.C.

(57) ABSTRACT

The present teachings provide a canopy that can be used in the area around a campfire for shelter during adverse weather conditions. The canopy includes a frame, a cover having a centrally located opening support by the frame, and a set of legs supporting the frame with the cover in an elevated position. The frame is constructed with a set of trusses which interconnect a lower support frame and an upper support frame. The trusses and support members are assembled such that the central opening remains unobstructed.

18 Claims, 4 Drawing Sheets

U.S. PATENT DOCUMENTS 7,264,012 B2 9/2007 Slade
7,448,400 B2 * 11/2008 Jensen ..... 135/121
7,451,776 B2 11/2008 Chen
2006/0266401 A1 * 11/2006 Wu ..... 135/141
2007/0295378 A1 * 12/2007 Lapping ..... 135/121
2008/0035194 A1 * 2/2008 Goldwitz ..... 135/121

* cited by examiner

CANOPY

CROSS-REFERENCE TO RELATED APPLICATIONS

This application claims the benefit of U.S. Provisional Application No. 61/303,936, filed on Feb. 12, 2010. The entire disclosure of the above application is incorporated herein by reference.

FIELD

The present disclosure relates to a canopy, and more particularly to a ventilating canopy configured for placement over a campfire or fire pit.

BACKGROUND

This section provides background information related to the present disclosure which is not necessarily prior art.

Outdoor enthusiasts often enjoy spending time around a campfire or bonfire. Adverse weather conditions, such as rain, snow, sleet, or hail, may hamper the ability to gather around a campfire. While known tents and umbrellas may have proven suitable for their intended purposes, a need for improvement in the art remains. In particular, there is a need for a canopy specifically adapted for placement over a fire pit which provides sufficient ventilation for the exhaust of combustions gases, while at the same time provides adequate protection from adverse weather conditions within an area proximate to the fire pit.

SUMMARY

This section gives a general summary of the disclosure, and is not a comprehensive disclosure of its full scope or all of its features.

The present teachings describe a canopy that can be used over a camp fire during adverse weather conditions. The canopy includes a frame, a cover supported by the frame and a set of vertical supports. The frame includes a set of trusses extending between a lower support frame and an upper support frame. The ends of the trusses are fixed to one of the lower and upper support frames. The trusses and support members define a central opening through the frame, such that the frame is exterior to the central opening. A first end of the vertical support members is fixed to the frame to support the canopy off the ground and above the fire pit. The cover is fixed to the frame, such that it is exterior to the central opening.

In another form, the present disclosure describes a canopy that includes a frame assembly, a plurality of legs, and a cover. The frame assembly includes an upper support section, a lower support section, and a plurality of trusses. The upper support section defines an upper opening and the lower support section defines a lower opening. The lower opening is generally concentric to the upper opening. The plurality of trusses extends between the upper support section and the lower support section. The frame is exterior to the upper opening. The legs support the frame assembly in an elevated configuration. The cover is fixed to the frame assembly such that they are exterior to the upper opening.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
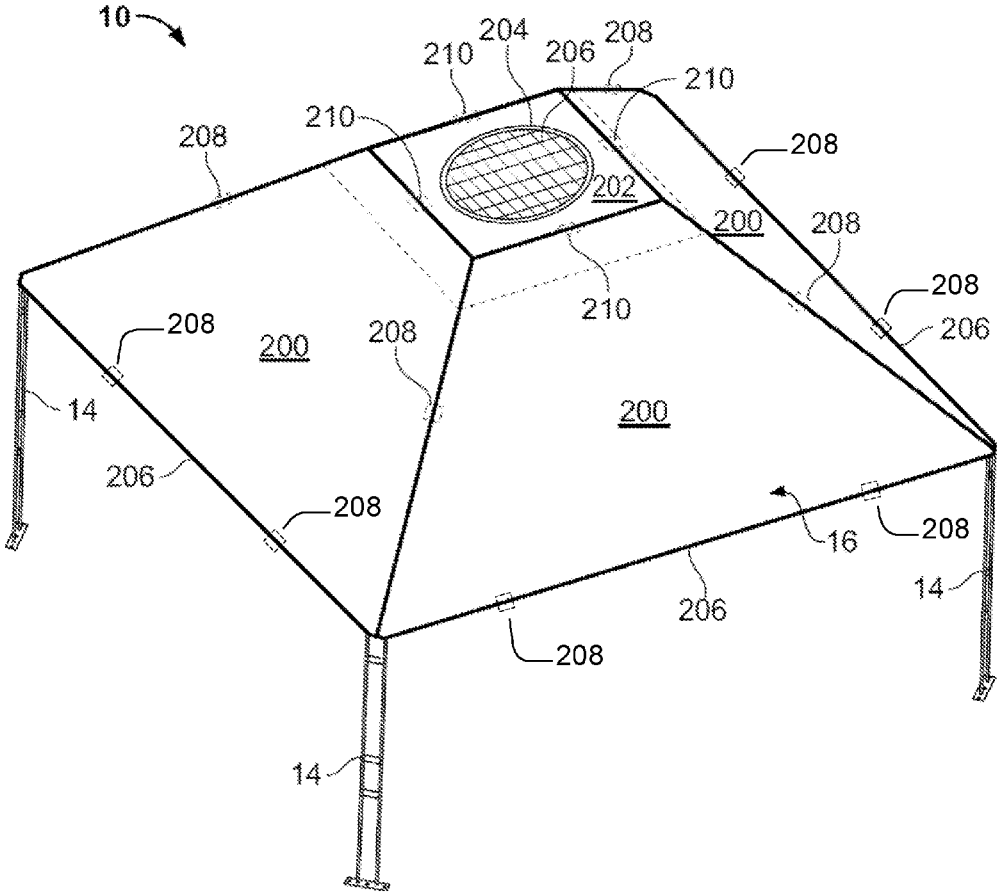
FIG. 1 is a perspective view of a canopy according to the principles of the present disclosure.

Corresponding reference numerals indicate corresponding parts throughout the several views of the drawings. This disclosure describes certain embodiments with specific dimensions. One skilled in the art should appreciate that these dimensions may be modified or scaled in accordance with the specific size and application of the canopy design.

DETAILED DESCRIPTION

Example embodiments will now be described more fully with reference to the accompanying drawings.

The following description is merely exemplary in nature and is not intended to limit the present teachings, application, or uses. It should be understood that throughout the drawings, corresponding reference numerals indicate like or corresponding parts and features. Therefore, it will be understood that the following discussions are not intended to limit the scope of the present teachings and claims herein.

Figure 3:
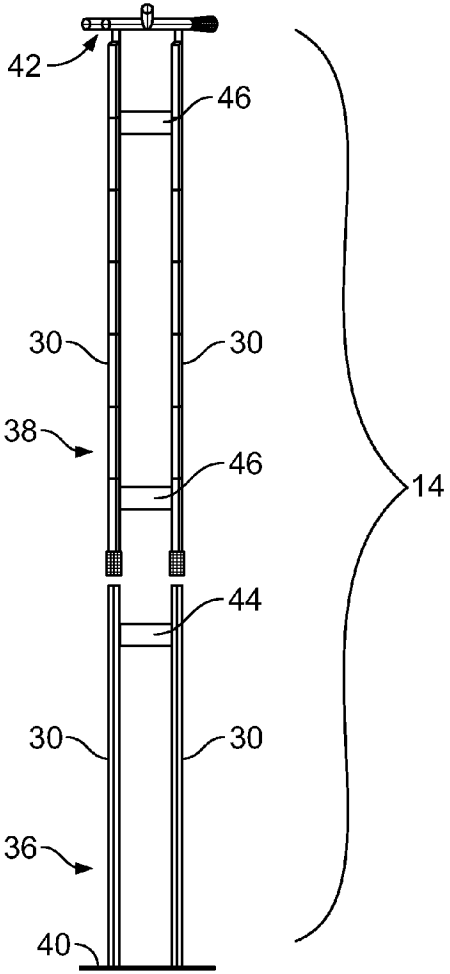
FIG. 3 is an exploded view of a vertical support member of the canopy frame in FIG. 2.
Figure 2:
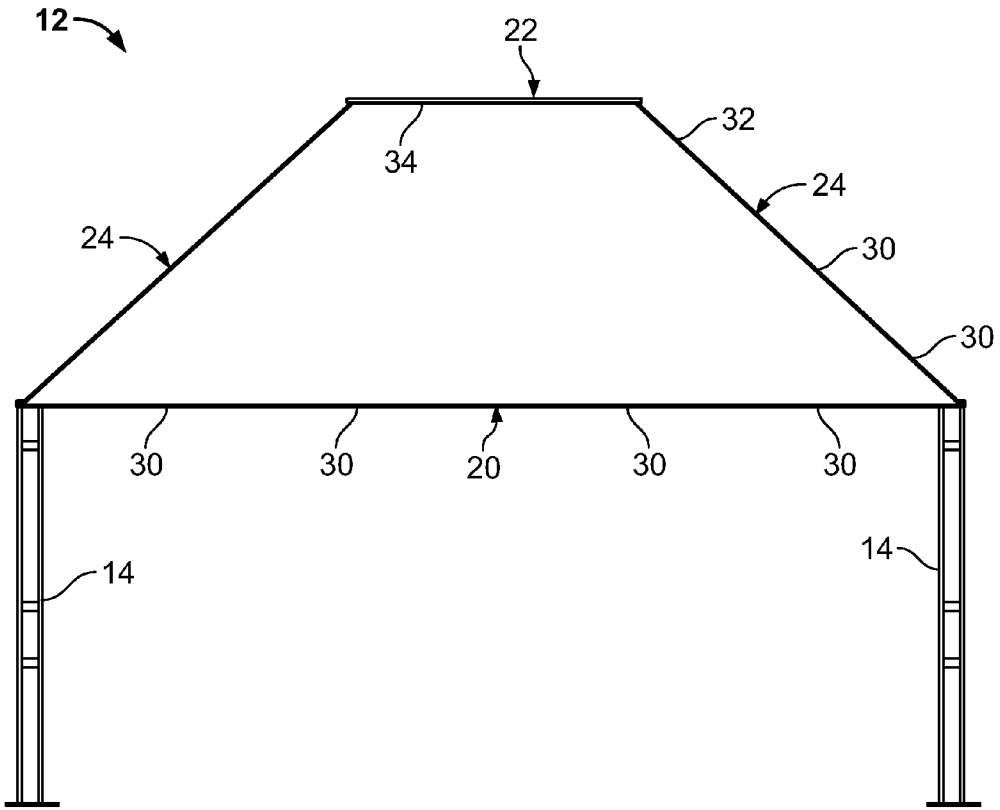
FIG. 2 is a side elevation of the canopy frame and vertical support members according to the principles of the present disclosure.

With reference to FIGS. 1-3, a canopy 10 is provided which includes a frame 12, a plurality of legs or vertical support members 14, and a cover member 16. The canopy 10 provides protection from the weather, while at the same time also provides ventilation for heat, smoke and combustion by-products emitted from a campfire. The frame 12 includes a lower support frame 20, an upper support frame 22, and a set of trusses or angled support members 24 interconnecting the lower and upper support frames 20, 22. In one embodiment, the lower support section 20 includes four lower support members 88 defining a square lower support frame, and the upper support section 22 includes four upper support members 90 defining a square upper support frame. The length of the lower support members 88 may be substantially greater than the length of the upper support members 90 and the length of the angled support members 24. In one embodiment, the dimension of the lower support section 20 is approximately 14'×14', the dimension of the upper support section 22 is approximately 2'9"×2'9", and the length of the angled support members 24 are approximately 8'1".

The lower and upper support members 88,90 and the angled support members 24, as well as leg assemblies 14 are generally thin-walled tubular members having any suitable cross-section, including but not limited to square, rectangular, or circular. A metal tubing is presently preferred, and in particular an extruded aluminum tubing for fabrication of the frame 12. The size and wall thickness of the tubing is dictated by the load carrying requirements of the frame 12. As presently preferred, a ¾" round 6061 aluminum tubing with a wall thickness of 0.065" is suitable for the 14'×14' canopy described above.

The frame 12 is preferably constructed with a set of knock-down rail members 30, 32, 34. The rail members are configured to be assembled in an end-to-end manner for providing supports of varying length. In addition, the length and end configuration of the rails are such that the frame 12 may only be assembled with each member in its proper position. For example, each side of the lower support frame 20 comprises four-3'6" rails 30 interconnected end-to-end. As presently preferred, one end (a male end) is formed by reducing the outside diameter (OD) of the rail to a dimension slightly smaller than the standard inside diameter (ID) of the rail at the other end (a female end). Each truss 24 comprises two-3'6" rails 30 and one-2'1" rail 32. To ensure proper assembly, the ends of rail 32 are simply square cut to maintain the standard OD at each end. In other words, rail 32 has two female ends. Each side of the upper support frame 22 comprises one-2'9" rail 34 having a male end formed at each end.

The end configuration described above provides a male end having a reduced cross section and a female end having a standard cross section. In an alternate embodiment, a female end may be formed by expanding the ID of the rail to a dimension slightly larger than the standard OD. The opposite end would have a standard OD to form the male end. Alternately, a separate coupling element may be secured onto the end of the rail to form the female end. The coupling element would be secured to the rail by any suitable means including welding, adhesive, or fasteners such as rivets, screws, pins or the like or by any combination of these means.

Figure 6:
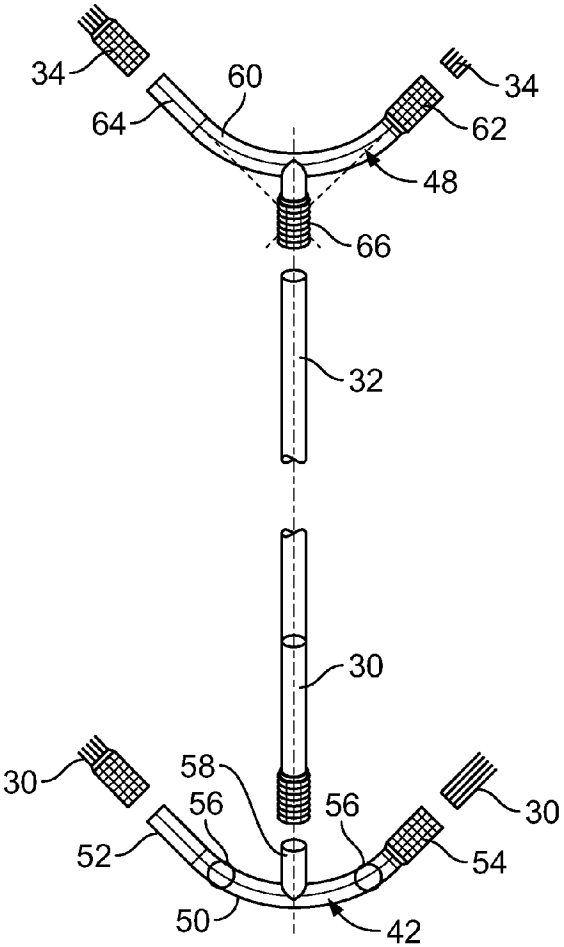
FIG. 6 is an exploded view of the corner assembly of the canopy frame in FIG. 2.

The frame 12 includes four identical leg assemblies 14. As shown in FIG. 3, each leg assembly 14 includes a lower leg member 36 having a pair of rails 30 and an upper leg member 38 also having a pair of rails 30. The lower leg member 36 has a base plate 40 secured at one end thereof. The base plate 40 has a through bore formed therein for receiving a stake 100 for securing the frame 12 into the ground as described hereafter. The upper leg member 38 has a lower corner piece 42 secured at one end thereof. As seen in FIG. 6, the lower corner piece 42 also form a portion of the lower support frame 20. Web elements 44, 46 extend between the rails 30 respectively to maintain them in a spaced parallel relationship. The lower leg member 36 and the upper leg member 38 are configured with complimentary male-female ends to be assembled in an end-to-end manner similar to the lower support frame 20.

Figure 4:
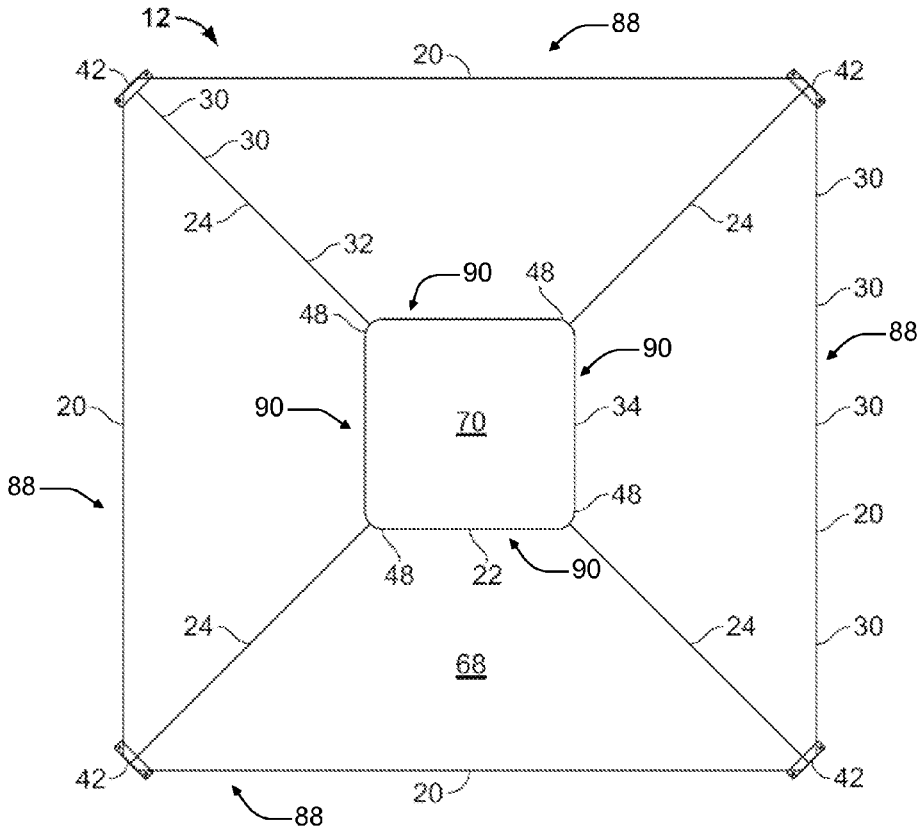
FIG. 4 is an overhead view of the canopy frame of FIG. 2.
Figure 5:
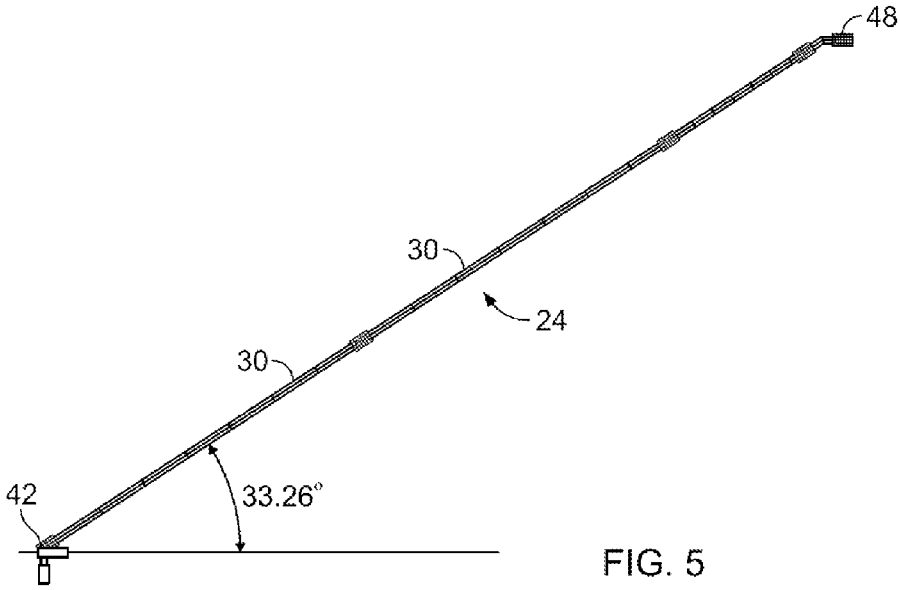
FIG. 5 is a detail of the canopy frame truss of the canopy frame in FIG. 2.

Turning now to FIGS. 2 and 4-6, the frame 12 is constructed using four identical lower corner piece 42 and four identical upper corner pieces 48 which are supported in a spaced apart relationship by trusses 24. With particular reference to FIGS. 5 and 6, the lower corner piece 42 includes a corner rail 50 generally curved at a radius of about 6" and forming a 90° angle. One end 52 of the corner rail 50 is sized to be inserted into a female end of the rail member 30. Another end 54 of the corner rail 50 is sized to receive a male end of the rail member 30. A pair of couplings 56 extend downwardly from the bottom surface of the corner rail 50. The couplings 56 are sized to receive the end of upper leg assembly 38. An extension 58 is angled upwardly from the top surface of the corner rail 50 at an acute angle, preferably about 33°. The extension 58 is sized to couple with an end of the rail 30 functioning as an angled support member 24.

The upper corner piece 48 includes a corner rail 60 generally curved to form a 90° angle. As presently preferred, both ends 62, 64 of the corner rail 60 are sized to form a female end and to receive the male end of rail member 34. A coupling 66 is angled downwardly from the bottom surface of the corner rail 60 at an angle complementary to the acute angle of the extension 58, preferably about 147°. Coupling 66 is sized to receive a male end of the rail member 32.

With reference to FIG. 2-8, a preferred construction of the frame 12 will be described. The lower support frame 20 is constructed using four lower corner pieces 50 and sixteen rail members 30. First, a lower rail is assembled using four rail members 30 connected in an end-to-end having a male end and a female end. The male end of lower rail is inserted into the end of one lower corner piece 42, and the female end of lower rail is inserted into the end of another lower corner piece 42. This procedure is repeated with the remaining lower corner pieces 42 and rail members 30 until the lower support frame 20 is constructed to form a square lower frame section. While a square lower frame has been described and illustrated herein, one skilled in the art will understand that the frame may be configured in any closed-form configuration (i.e. circle, ellipse, or polygon).

The upper support frame 22 is constructed in a similar manner using four upper corner pieces 48 and four rail members 34. The male ends of a rail member 34 are inserted into the end 62, 64 of the upper corner pieces 48. This procedure is repeated with the remaining upper corner pieces 48 and rail members 34 until the upper support frame 22 is constructed to form a square upper frame sections. Again, while a square upper frame has been described and illustrated herein, one skilled in the art will understand that the frame may be configured in any closed-form configuration.

The lower support frame 20 and the upper support frame 22 are connected together using twelve rail members 30, 32. First, an angled truss 24 is assembled using two rail members 30 and one rail member 32 connected in an end-to-end manner. The female end of truss 24 is inserted into the coupling 66 of one upper corner piece 48, and the female end of the truss 24 is inserted into the extension 58 of a lower corner piece 42. This procedure is repeated with the rail members 30, 32 until the lower support frame 20 connected to the upper support frame 22. As assembled, the lower support frame 20 defines a lower opening 68, and the upper support frame 22 defines an upper opening 70. As best seen in FIG. 4, the lower opening 68 is generally concentric with the upper opening 70.

Figure 8:
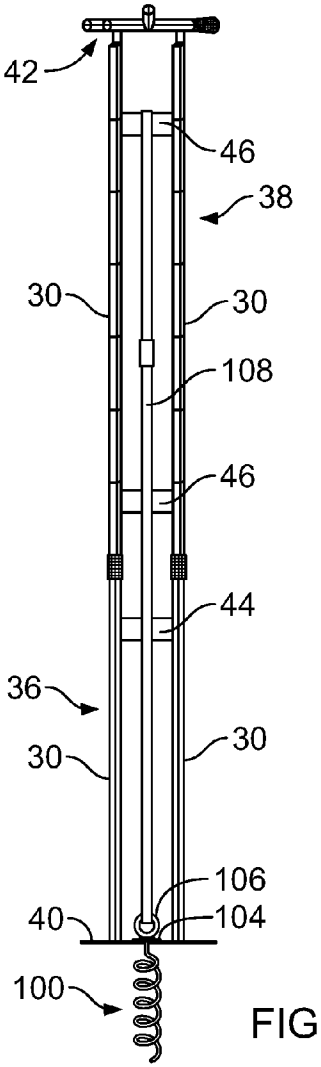
FIG. 8 is a side elevation illustrating the anchoring system.
Figure 7:
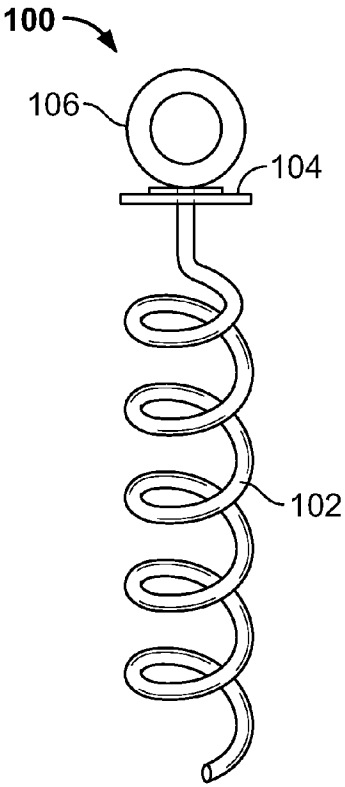
FIG. 7 is a detail of a anchor stake for securing the canopy frame to the ground.

With reference to FIGS. 1-3 and 8, the canopy 10 is completed by installing the lower leg members 36 to the upper leg members 38. With reference now to FIGS. 7 and 8, the canopy is designed to be secured to the ground with a self-contained tie-down system which does not extend beyond the envelop of the frame. Specifically, a stake 100 is provides which has a helical portion 102 threaded through a hole (not shown) in the base plate 40. A washer 104 is disposed between the base plate 40 and an eyelet 106 to secure the leg assembly to the ground. An adjustable strap 108 is feed through the eyelet 106 and wraps over the web plates 44, 46 of the lower and upper leg assemblies 36, 38. The adjustable strap is tensioned to pull the frame 12 towards the stake 100. In this manner, the tie-down system can generate sufficient downward force to hold the canopy 10 in place.

While the canopy has been described and illustrated using a pair of legs at each corner, one skilled in the art will understand that the number of legs and their location may vary as needed to support the frame in an elevated position. For example, a single leg may be employed to elevate the frame 12. Likewise, the legs 14 are described as being about 7 feet in length, however, any length sufficient to prevent fire and extreme heat, produced by a campfire pit, from reaching the canopy 10, may be used to support and elevate the frame 12. To this point, it has been observed that the bottom of the canopy 10, or in other words the lower frame section should be elevated at least five feet above the top of the campfire or fire pit.

With reference to FIG. 1, a cover member 16 is removably secured the frame 12. The cover member 16 includes a series of trapezoidal panels 200 joined to each other along a seam so that the cover member 16 is fitted to the frame 12. A top panel 202 extends over the upper support frame 22 and has an opening 204 formed therethrough to form a flue. In this way, the frame 12 does not obstruct the upper opening 70 which provides an outlet for the heat, smoke and other combustion by-products produced by the campfire. The outer or bottom edge 200 of the cover 16 is secured to the lower frame section 20. The cover may also be secured to the trusses and the lower support frame at 208. The top panel 202 in combination with the lower frame ties to secure the upper portion of the cover 16 in place. Optionally, the top may be secured to the upper support frame at 210. The cover member 16 is fixed to the frame 12 preferably with bungee ties which include a loop of elastic cord having a ball at the free end of the loop. Other suitable means, including but not limited to string, cable ties, wire, and the like may be used to releasably secure the cover 16 to the frame 12.

The cover member 16 may be formed from a heat-resistant material adequate to maintain its structural integrity when exposed to temperatures above a campfire. The cover member 16 may be formed with a material having fire retardant qualities to further safeguard against failure of the cover during use. The cover member 16 may also include a foil backing facing toward the interior of the canopy in order to reflect the heat produced by the campfire pit, and thus provide heat to the area beneath the canopy 10. With reference to FIG. 1, the cover 16 may include a spark arresting screen 206 which is placed between the frame 12 and the cover 16. The screen 206 lies against the upper portion of the cover 26 and across the flue opening 204.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention. For example, various components have been described as being releasably secured to one another. However, select components may be fixedly secured to each other for facilitating in the fabrication and assembly of a canopy.

What is claimed is:

1. A canopy comprising:

a plurality of first rails, each of said first rails having first male and female ends, wherein the first female end sized to receive the first male end, wherein two first rails are operable to interconnect in end-to-end fashion to form a lower frame rail;

a set of lower corner brackets, each of said set of lower corner brackets having a lower corner rail with a second male end sized for insertion into the first female end, a second female end sized for receiving the first male end, a first coupling extending generally perpendicular from the lower corner rail, and an extension extending from the lower corner rail at an acute angle relative to the lower corner rail, wherein the set of lower corner brackets are operable to interconnect a set of lower frame rails to form a lower support frame;

a plurality of second rails, each of said second rails having a third male end and a third female end;

a set of upper corner brackets, each of said set of upper corner brackets having an upper corner rail with a fourth male end sized for insertion into the third female end and a fourth female end sized for receiving the third male end, and a second coupling extending from the upper corner rail at an angle complementary to the obtuse angle of the lower corner bracket, wherein the set of upper corner brackets are operable to interconnect a set of second rails to form an upper support frame;

a plurality of third rails, each of said third rails having fifth male and female ends, the fifth female end sized for receiving the fifth male end, wherein two third rails are operable to interconnect in end-to-end fashion to form a truss rail and sized for receiving the extension on the lower corner bracket, wherein the fifth male end sized for insertion into the second coupling on the upper corner bracket, and wherein a set of truss rails are operable to interconnect the lower support frame to the upper support frame to form a canopy frame;

a set of legs, each leg having a sixth male end sized for insertion into the first coupling of the lower corner bracket; and a cover member sized to extend over the canopy frame, wherein the cover member and the upper support frame define a central opening through the canopy.

2. A canopy comprising:

a plurality of first rails, each of the first rails having a female end and a male end for interconnecting with the female end of an adjacent rail in an end to end manner;

a plurality of second rails, wherein the length of the first rail is different than the length of the second rail, each of the second rails having a female end and a male end for interconnecting with the female end of an adjacent rail in an end to end manner;

a first support section having four frame members interconnected to define a first quadrilateral frame, each of the first frame members being constructed using the plurality of first rails;

a second support section having four frame members interconnected to define a second quadrilateral frame, wherein a perimeter of the first quadrilateral frame is greater than a perimeter of the second quadrilateral frame;

four truss members, each of the truss members being constructing using at least one of the first rails and at least one of the second rails, wherein a first end of each of the plurality of the truss members is fixed to the first support section at a corner of the first quadrilateral frame and a second end of each of the plurality of the truss members is fixed to the second support section at a corner of the second quadrilateral frame to form a frustro-pyramidal frame having an unobstructed opening defined therethrough;

four vertical support members, each of the vertical support members being constructed of at least one first rail wherein a first end of each of the four of vertical support members is fixed to the frustro-pyramidal frame at the corners of the first quadrilateral; and a cover member having four quadrilateral panels extending between the first support section and the second support section and fixed to the frustro-pyramidal frame and surrounding the unobstructed opening to define a flue.

3. The canopy of claim 2, wherein the first support section and second support section are concentrically arranged.

4. The canopy of claim 3, wherein the first support section and the second support section are square, the length of a side of the first support section being approximately three to four times greater than the length of a side of the second support section.

5. The canopy of claim 4, wherein the length of the frame member of the first support section is greater than the length of the truss member.

6. The canopy of claim 5, wherein the length of the frame member of the first support section is approximately 60% longer than the length of the truss member.

7. The canopy of claim 3, wherein a first edge of at least one cover panel is fixed to at least one perimeter of the frame members of the first support section and a second edge of at least one cover panel is fixed to at least one perimeter of the frame members of the second support section.

8. The canopy of claim 3, wherein the truss members form a 45° angle with a plane formed by the first quadrilateral frame and a 135° angle with a plane formed by the second quadrilateral frame.

9. The canopy of claim 2, further comprising a base structure, wherein a second end of at least one of the vertical support members is fixed to the base structure.

10. The canopy of claim 2, wherein the cover member comprises a continuous cover panel.

11. The canopy of claim 2, wherein the cover member comprises four separate cover panels.

12. The canopy of claim 2, wherein the cover member is a fire-retardant material.

13. The canopy of claim 2, wherein the cover member includes a foil backing.

14. The canopy of claim 2, wherein at least one of the frame members and at least one of the vertical support members is extruded aluminum.

15. The canopy of claim 2, wherein at least one of the frame members and at least one of the vertical support members has a square cross-sectional area.

16. The canopy of claim 2, wherein the length of the vertical support members is approximately seven feet.

17. The canopy of claim 2, wherein at least one of the quadrilateral cover panels is fixed to the frame with a fastening device selected from the group consisting of string, cable ties, wire, elastic cord, and combinations thereof.

18. The canopy of claim 2, further comprising a plurality of third rails, wherein the length of the third rail is different than the lengths of the first and second rails, each of the frame members of the second support section being constructed using a third rail.

* * * * *